US010671020B2

(12) United States Patent
Yoshioka et al.

(10) Patent No.: US 10,671,020 B2
(45) Date of Patent: Jun. 2, 2020

(54) IMAGE FORMING APPARATUS WITH BLOCK MEMBER IN CONTACT WITH IMAGE BEARING MEMBER FOR BLOCKING AIRFLOW

(71) Applicant: CANON KABUSHIKI KAISHA, Tokyo (JP)

(72) Inventors: Mahito Yoshioka, Numazu (JP); Takashi Yano, Mishima (JP); Yuji Mitsui, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/430,608

(22) Filed: Jun. 4, 2019

(65) Prior Publication Data

US 2019/0384216 A1 Dec. 19, 2019

(30) Foreign Application Priority Data

Jun. 13, 2018 (JP) ..... 2018-113186

(51) Int. Cl.
*G03G 21/00* (2006.01)
*G03G 21/20* (2006.01)

(52) U.S. Cl.
CPC ... *G03G 21/206* (2013.01); *G03G 2221/1645* (2013.01)

(58) Field of Classification Search
CPC ..... G03G 15/0189; G03G 15/161; G03G 21/206; G03G 2215/0122; G03G 2215/0125; G03G 2215/0132; G03G 2221/1645
USPC ..... 399/92, 101, 162, 302, 308
See application file for complete search history.

(56) References Cited

U.S. PATENT DOCUMENTS

| | | | | |
|---|---|---|---|---|
| 9,625,877 | B2 * | 4/2017 | Yamashita | G03G 21/206 |
| 2007/0212104 | A1 * | 9/2007 | Miyamoto | G03G 21/206 399/92 |
| 2010/0054795 | A1 * | 3/2010 | Goda | G03G 15/0813 399/102 |
| 2014/0376950 | A1 * | 12/2014 | Hara | G03G 21/206 399/92 |
| 2018/0101133 | A1 * | 4/2018 | Oya | B65H 31/02 |

FOREIGN PATENT DOCUMENTS

| | | | |
|---|---|---|---|
| JP | 2006098904 | A * | 4/2006 |
| JP | 2013097011 | A * | 5/2013 |
| JP | 2014232130 | A * | 12/2014 |
| JP | 5934153 | B2 | 6/2016 |

* cited by examiner

*Primary Examiner* — Robert B Beatty
(74) *Attorney, Agent, or Firm* — Canon U.S.A., Inc. I.P. Division

(57) ABSTRACT

An image forming apparatus including a facing portion provided at a position facing a surface of an image bearing member that corresponds to a portion between a transfer unit and a cleaning unit, wherein a first space for conveying the recording material from the transfer unit to the fixing unit, and a second space between the surface of the image bearing member and the facing portion are formed in the image forming apparatus, and wherein the image forming apparatus includes a block member positioned in the second space and having one end side fixed to the facing portion on a side closer to the first space, the block member being configured to block a flow of an air current, the block member having the other end side in contact with the image bearing member.

21 Claims, 10 Drawing Sheets

IMAGE FORMING APPARATUS WITH BLOCK MEMBER IN CONTACT WITH IMAGE BEARING MEMBER FOR BLOCKING AIRFLOW

BACKGROUND OF THE INVENTION

Field of the Invention

The present disclosure relates to an image forming apparatus that forms a toner image with use of an image bearing member.

Description of the Related Art

The following operation is generally known as an image formation operation of an image forming apparatus using toner. First, an electrostatic latent image is formed on a uniformly charged photosensitive member by an exposure unit that exposes the photosensitive member to light based on image information, and a toner image is developed from this electrostatic latent image by a development unit. This toner image is transferred onto a recording material, and the toner image is fixed onto the recording material by subjecting the recording material to heating fixation by a fixing unit. This is a commonly practiced operation. Further, a color image forming apparatus employs a method that uses a plurality of sets of the photosensitive member, the development unit, and a primary transfer unit, and primarily transfers the toner images on the photosensitive members onto an intermediate transfer member to form a toner image of respective colors, and then secondarily transfers them onto the recording material. Now, the above-described photosensitive member and the above-described intermediate transfer member are each an image bearing member having a function of temporarily holding the unfixed toner image. Further, the photosensitive member and the development unit are often configured as an integrated cartridge unit to simplify supply of toner and replacement of a component by a user. Similarly, the intermediate transfer member and the primary transfer unit are also configured as an integrated transfer unit in many cases.

The toner image formed on the photosensitive member or the intermediate transfer member is not one-hundred percent transferred by the transfer unit, and transfer residual toner remains. Such transfer residual toner is scraped off and collected by a cleaning unit, which is in a form of a blade and brought into contact with the rotating photosensitive member or intermediate transfer member. The above-described cleaning unit is a fixed object in contact with a rotational member, so that frictional heat is generated at the contact portion (hereinafter referred to as a cleaning nip).

When using a development roller rotating in contact with the photosensitive member, in the development unit, a development blade is brought into contact with the development roller and rubs the toner, which has been guided to the contact portion (hereinafter referred to as a development nip), along with the rotation of the development roller. By being nabbed, the toner is provided with a charge and is electrostatically moved onto the photosensitive member, thereby developing the electrostatic latent image. It is apparent that frictional heat is also generated at the development nip similarly to the above-described cleaning nip.

The portion where the frictional heat is generated is an area where the toner exists, and should be cooled to prevent the toner from being thermally softened. On the other hand, a portion such as the cleaning nip and the development nip tends to be disposed at a deep portion in the cartridge unit or the transfer unit for the purpose of, for example, preventing a toner leak. Thus, such a portion is difficult to be cooled just by a wind blowing onto an outer surface of the cartridge unit or the transfer unit.

In these cases, it is known to expose a part of the photosensitive member and the intermediate transfer member foil ling the cleaning nip from the cartridge unit and the transfer unit disposed in the image forming apparatus, and cool the exposed area by a blowing wind with use of a blower unit such as a fan. In this case, the exposed area itself does not contain the cleaning nip, and therefore the cleaning nip is indirectly cooled as the exposed area is moved. Further, the photosensitive member is in indirect contact with the development nip via the development roller, and the intermediate transfer member is in indirect contact with the development nip via the photosensitive member and the development roller. Accordingly, this method can also indirectly cool the development nip by cooling the exposed portion of the photosensitive member or the intermediate transfer member.

On the other hand, a reduction in a size of the image forming apparatus leads to a tendency to dispose the image bearing member, such as the photosensitive member and the intermediate transfer member, and the fixing device serving as the fixing unit in proximity to each other. In such layout, the blowing wind may easily flow into the fixing device after cooling the image bearing member, thereby raising a possibility of occurrence of a fixing failure. In this instance, there is disclosed a configuration in which air is suctioned with use of an axial fan 101 from an opposite side of the fixing device as a wind path for cooling an intermediate transfer belt 100 (Japanese Patent No. 5934153, FIG. 10B). Japanese Patent No. 5934153, FIG. 10B describes that the suctioned air is discharged from an exhaust port 102 on the same side as the air intake by turning around the blowing wind with use of unevenness of a circling wind due to the axial fan 101. Then, Japanese Patent No. 5934153, FIG. 10B describes provision of a block unit 104 that blocks a flow of an air current from a side of the cooled intermediate transfer belt as illustrated in FIG. 10A.

However, if the image forming apparatus does not include a powerful guiding wind path, the blowing wind suctioned into the image forming apparatus flows in various directions depending on a structure inside the image forming apparatus after contacting a surface of the image bearing member 100, and the wind heading toward the fixing device cannot be sufficiently blocked.

SUMMARY OF THE INVENTION

The present disclosure is directed to an image forming apparatus including a block member disposed in contact with the image bearing member.

Further features of the present disclosure will become apparent from the following description of exemplary embodiments with reference to the attached drawings.

According to an aspect of the present disclosure, an image forming apparatus includes an image bearing member configured to bear a toner image, a transfer unit configured to transfer the toner image from the image bearing member to a recording material, a cleaning unit provided in contact with the image bearing member and configured to remove toner remaining on the image bearing member after the transfer, a fixing unit configured to fix the toner image onto the recording material by heating the toner image on the recording material, and a facing portion provided at a position facing a surface of the image bearing member that corresponds to a portion between the transfer unit and the cleaning unit. A first space for conveying the recording material from the transfer unit to the fixing unit, and a second space between the surface of the image bearing member and the facing portion are formed in the image forming apparatus. The image forming apparatus further includes a block member positioned in the second space and having one end side fixed to the facing portion on a side closer to the first space. The block member is configured to block a flow of an air current. The block member has the other end side in contact with the image bearing member.

DESCRIPTION OF THE EMBODIMENTS

In the following descriptions, how the present disclosure can be implemented will be described in detail based on exemplary embodiments thereof by way of example with reference to the drawings. However, dimensions, materials, shapes, a relative layout, and the like of components that will be described in the exemplary embodiments can be changed as appropriate depending on a configuration of an apparatus to which the present disclosure is applied and various kinds of conditions. In other words, they are not intended to limit the scope of the present disclosure to the exemplary embodiments that will be described below.

In addition, each of the exemplary embodiments is not necessarily independent of one another, and a part of each of the exemplary embodiments can also be applied to the other exemplary embodiment.

(1) Image Forming Apparatus

Figure 1:
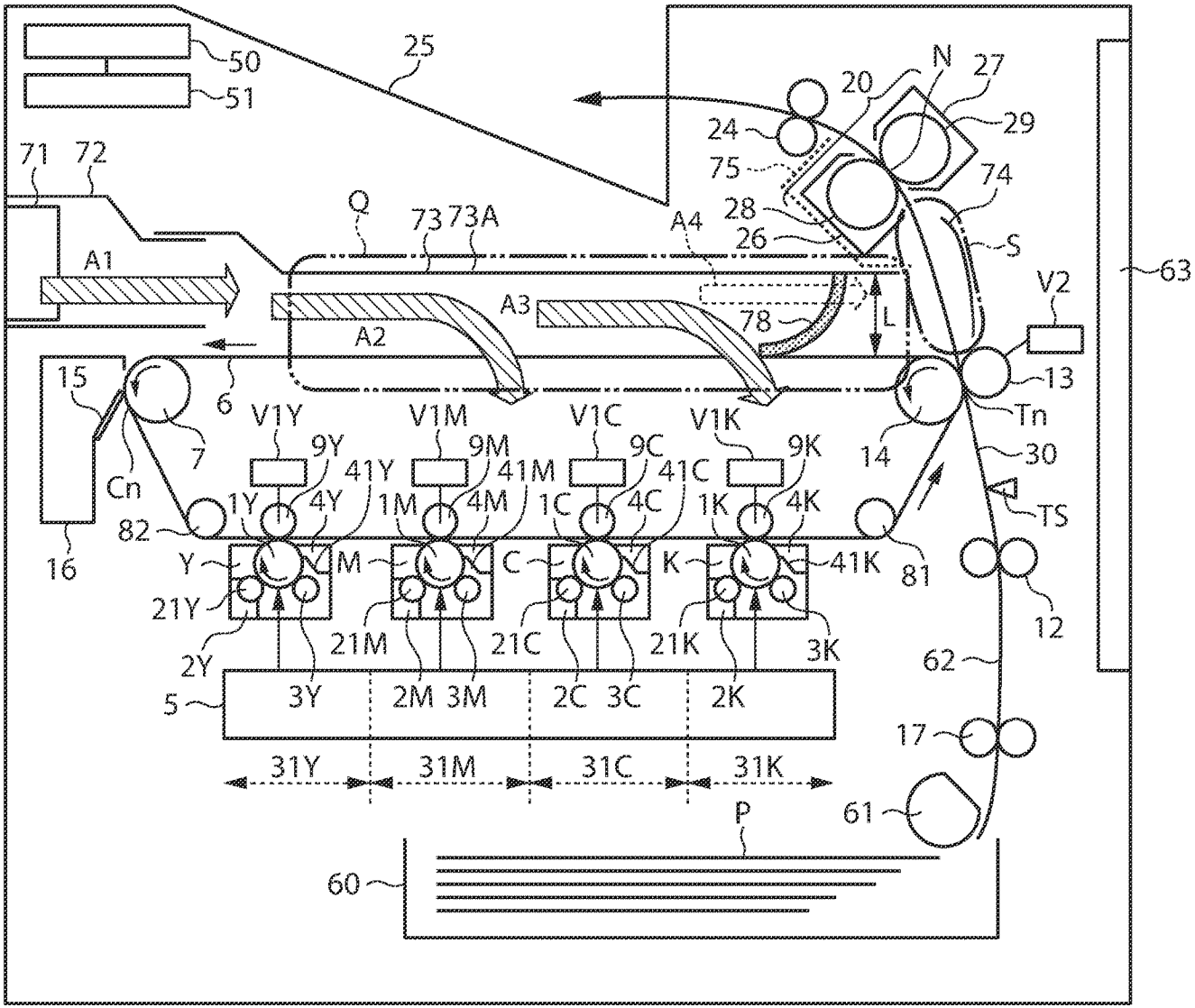
FIG. 1 illustrates a configuration of an image forming apparatus according to a first exemplary embodiment.

FIG. 1 illustrates a configuration of one example of an image forming apparatus according to a first exemplary embodiment. This image forming apparatus is a full-color laser printer that acquires a full-color image by overlaying toner images in four colors, i.e., yellow, cyan, magenta, and black, on one another with use of the electrophotographic method.

The image forming apparatus according to the present exemplary embodiment includes a recording material cassette 60, which feeds a recording material P such as paper, and a conveyance unit 30, which conveys the fed recoding material P. Further, the image forming apparatus according to the present exemplary embodiment includes four image forming stations 31Y, 31M, 31C, and 31K for yellow (Y), magenta (M), cyan (C), and black (K), respectively, linearly arrayed in a horizontal direction in an installed state. Then, the image forming apparatus includes a fixing device 20 that fixes the toner images onto the recording material P, and a control unit 50 as a control unit that controls a condition for the image formation and the like. Further, the image forming apparatus includes a video controller 51 that forms an image signal for the image formation from image data transmitted from a computer or an image scanner connected to the image forming apparatus. Hereinafter, characters Y, M, C, and K placed at ends of reference numerals in the drawings indicate the color of the toner, and will be omitted in the descriptions below except when necessary.

Each of the image forming stations 31 includes a photosensitive member (hereinafter referred to as a photosensitive drum) 1 as a drum-type image bearing member, and a charging roller 3 as a charging unit. Further, the image forming station 31 includes a development device 2 as a development unit including a development roller 21, which is a developer bearing member, and a cleaning device 4 as a cleaning unit including a cleaning blade, which is a cleaning member 41.

A laser scanning exposure device 5 (hereinafter referred to as an exposure device) is an exposure unit. The exposure device 5 is provided in correspondence with each of cartridges Y, M, C, and K, and forms an electrostatic latent image on a surface of the photosensitive drum 1 by exposing the corresponding photosensitive drum 1 of each of the cartridges Y, M, C, and K to light.

An intermediate transfer belt 6 is an image bearing member in the form of an endless belt. The intermediate transfer belt 6 is provided along the direction in which the image forming stations 31 are arrayed. The intermediate transfer belt 6 is stretched around four rollers, i.e., a driving roller 7, a tension roller 81, a stretching roller 82, and a secondary transfer counter roller 14. Then, the intermediate transfer belt 6 is circulated and moved in a direction indicated by arrows along the photosensitive drum 1 of each of the image forming stations 31 being driven by the driving roller 7.

A primary transfer roller 9 is used as a primary transfer unit that transfers the toner image formed on the surface of the photosensitive drum 1 onto an outer circumferential surface (surface) of the intermediate transfer belt 6. The primary transfer roller 9 is disposed so as to face the photosensitive drum 1 across the intermediate transfer belt 6.

Cleaning units 15 and 16 constitute a belt cleaning device that cleans the intermediate transfer belt 6. The cleaning unit 15 is a belt cleaning blade member in the belt cleaning device, and the cleaning unit 16 is a waste toner container that contains toner obtained by scraping toner remaining on the intermediate transfer belt 6 with use of the blade. The belt cleaning blade member 15 according to the present exemplary embodiment is provided so as to face the driving roller 7.

An inner wall 73 of the image forming apparatus includes a facing portion that is a wall surface facing an upper surface of the intermediate transfer belt 6 and will be described below. The inner wall 73 including the facing portion is connected to an intake fan 71 and a duct 72 thereof mounted on a left side of the image forming apparatus as illustrated in FIG. 1. The inner wall 73, which is the facing portion, functions as a wind path duct that guides a blowing wind taken in from the intake fan 71 and the duct 72 to the surface of the intermediate transfer belt 6, which is the image bearing member after a secondary transfer.

The image forming apparatus includes a sheet feeding roller 61, a conveyance roller 17, a registration roller 12, a pair of discharge rollers 24, and the like as units for conveying the recording material P.

The image forming apparatus according to the present exemplary embodiment also includes the recording material cassette 60 from which the recording material P is fed, and the recording material cassette 60 is equipped with the sheet feeding roller 61 used for feeding the recording material P to the image forming apparatus. The recording material P is conveyed along a recording material feeding path 62 by the conveyance roller 17, and is fed toward the registration roller 12.

A portion S surrounded by a dashed-and-dotted line indicates a first space that is a space of a path for conveying the recording material P from a transfer unit that performs the secondary transfer to the fixing device 20 serving as the fixing unit, and includes a conveyance guide 74.

The fixing device 20 is the fixing unit for heating the toner images to fix the toner images onto the recording material P, and includes a heating roller 28 and a pressing roller 29 contained in fixing frame members 26 and 27. The fixing device 20 also includes a temperature detection element 76 that detects a temperature on a surface of the heating roller 28 in a non-contact manner, and the temperature detection element 76 is disposed at a longitudinally central position of the heating roller 28, which is a fixing roller. The fixing device 20 is held on a fixing device support member (indicated with a broken line) 75 in the image forming apparatus.

As an image formation operation of the image forming apparatus, upon receiving image data from an external apparatus such as a host computer, the video controller 51 transmits a print signal to the control unit 50 such as a central processing unit (CPU), and converts the received image data into bitmap data. Upon receiving the print signal, the control unit 50 transmits a driving signal to each member to control the image formation, thereby performing an image formation control sequence.

When the image formation control sequence is performed, first, the photosensitive drum 1 is rotated in a direction indicated by an arrow. Then, an outer circumferential surface (surface) of the photosensitive drum 1 is uniformly charged so as to have a predetermined polarity and potential by the charging roller 3. In the present exemplary embodiment, the surface of the photosensitive drum 1 is charged so as to become negative in polarity. Then, the exposure device 5 emits laser light corresponding to an image signal derived from the bitmap data, and scans and exposes the surface of the photosensitive drum 1 with and to the light. As a result, an electrostatic latent image corresponding to the image data is formed on the charged surface of the surface of the photosensitive drum 1.

The development device 2, which is the development unit, allows the negatively-charged toner to be developed, by setting a development voltage that is applied from a development bias power source to the development roller 21 to an appropriate value between a charging potential and a potential of the latent image (exposed portion). Then, the negatively-charged toner is selectively attached from the development roller 21 onto the electrostatic latent image on the surface of the photosensitive drum 1, whereby the electrostatic latent image is developed. Details of an internal configuration and an operation of the development device 2, which is the development unit, will be described separately.

The single-color toner image that is developed on the surface of the photosensitive drum 1 by each of the development devices 2 is transferred onto the outer circumferential surface (surface) of the intermediate transfer belt 6 rotating in synchronization with the rotation of the photosensitive drum 1 at a substantially equal speed thereto. More specifically, a transfer voltage having a positive polarity, which is opposite to the polarity of the toner, is applied from a first transfer bias power source V1 to the primary transfer roller 9 corresponding to the photosensitive drum 1. As a result, the toner images in respective colors are primarily transferred from the surface of the photosensitive drum 1 onto the surface of the intermediate transfer belt 6 so as to be overlaid on one another. Accordingly, the color toner image is borne on the surface of the intermediate transfer belt 6.

Transfer residual toner remaining on the surface of the photosensitive drum 1 after the primary transfer of the toner images is removed by using the drum cleaning member 41 provided to the cleaning device 4. Then, the transfer residual toner removed by using the drum cleaning member 41 is collected into a waste toner container included in the cleaning device 4. In the present exemplary embodiment, a cleaning blade made of a urethane blade is used as the drum cleaning member 41, and the drum cleaning member 41 is provided so as to be oriented in an opposite direction of the rotational direction of the photosensitive drum 1.

In the above-described manner, the charging process, the exposure process, the development process, and the primary transfer process are performed with respect to each of the colors of yellow, magenta, cyan, and black in synchronization with the rotation of the intermediate transfer belt 6. Through these processes, the toner images of the respective colors are formed on the surface of the intermediate transfer belt 6 while being sequentially overlaid on one another. In other words, the intermediate transfer belt 6 bears the unfixed toner image of the color image to be formed on the recording material P.

The recording material P set in the recording material cassette 60 is fed by the sheet feeding roller 61, and is conveyed to the registration roller 12 by the conveyance roller 17 through the recording material feeding path 62.

A leading edge of the recording material P conveyed to the registration roller 12 is detected by a top sensor TS provided immediately after the registration roller 12. The registration roller 12 conveys the recording material P to a transfer nip portion Tn formed of the intermediate transfer belt 6 and a secondary transfer roller 13 of the secondary transfer unit while synchronizing a timing thereof with an image position on the surface of the intermediate transfer belt 6 in response to the detection of the leading edge of the recording material P by the top sensor TS. The secondary transfer roller 13, which is the transfer unit, is disposed so as to be in contact with the surface of the intermediate transfer belt 6 at a position where it faces the secondary transfer counter roller 14, whereby the transfer nip portion Tn is formed between the intermediate transfer belt 6 and the secondary transfer roller 13. The image forming apparatus according to the present exemplary embodiment conveys the recording material P at a speed of 180 mm/second.

The color toner image borne on the surface of the intermediate transfer belt 6 is collectively transferred (secondarily transferred) onto the recording material P by application of a voltage opposite in polarity to the polarity of the toner from a second transfer bias power source V2 to the secondary transfer roller 13, which is the transfer unit.

The recording material P holding the toner image on the surface thereof passes through a conveyance path space S, which is the first space, and is conveyed to the fixing device 20. A size of the conveyance path space S, which is the first space, in a horizontal direction in FIG. 1 is set so as to allow the toner image on the recording material P to be conveyed to the fixing device 20 without being deformed regardless of a type of the recording material P or an amount of the toner transferred onto the recording material P.

The color toner image transferred onto the recording material P is heated and fixed onto the recording material P by being fed into a fixing nip portion N of the fixing device 20 as the fixing unit and receiving heat and a pressure therein. The control unit 50 controls the temperature on the surface of the heating roller 28 for fixing the toner image onto the recording material P to be an optimum temperature based on a result of the detection by the temperature detection element 76. The recording material P that has moved out of the nip portion N of the fixing device 20 is discharged onto a discharge tray 25 by the pair of discharge rollers 24.

Transfer residual toner remaining on the surface of the intermediate transfer belt 6 after the transfer of the color toner image is removed by the belt cleaning member 15 of the belt cleaning device, which is the cleaning unit. The transfer residual toner removed by the belt cleaning member 15 is collected into the waste toner container 16. In the present exemplary embodiment, a cleaning blade made of a urethane blade is used as the cleaning member 15 similarly to the drum cleaning member 41 of the photosensitive drum 1. Both the cleaning members 41 and 15 each include a contact portion that comes in contact with the photosensitive drum 1 or the intermediate transfer belt 6, which is the image bearing member. Then, the contact portion constitutes a portion where frictional heat is generated by being slidably rubbed against the image bearing member.

Figure 2:
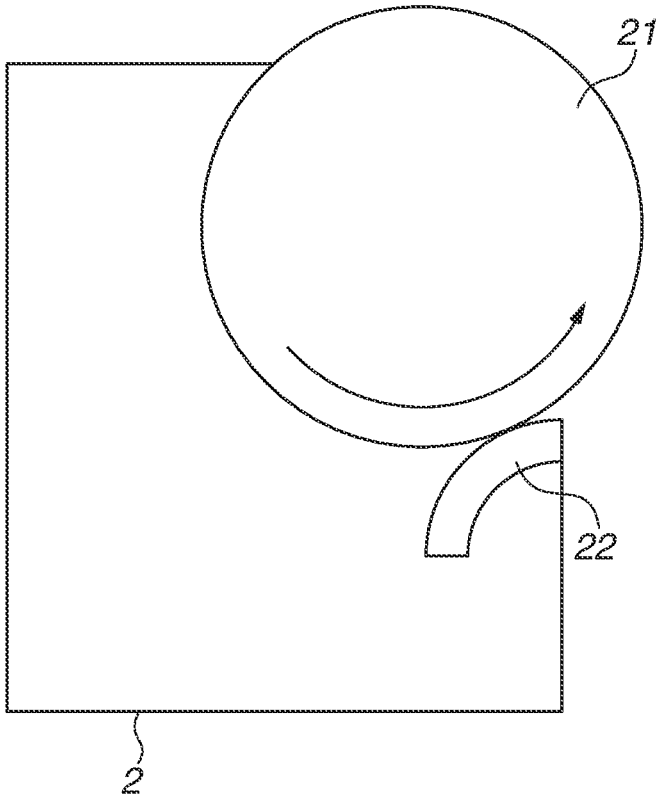
FIG. 2 illustrates a configuration of a development device according to the first exemplary embodiment.

There is also a portion where the frictional heat is generated in the development device 2, which is the development unit, similarly to the above-described cleaning unit. FIG. 2 is an enlarged view schematically illustrating the development device 2. The development devices 2 of the yellow, cyan, magenta, and black colors are configured similarly to one another. The development roller 21 is rotated in the same direction as the photosensitive drum 1 in the development device 2 storing the toner therein. The development blade 22 is provided so as to be oriented in an opposite direction to the rotational direction of the development roller 21, and forms a development nip by being in contact with the development roller 21 and rubs a surface of the development roller 21. The toner held on the surface of the development roller 21 is guided to the development nip between the above-described development roller 21 and development blade 22, and is negatively charged due to friction at the development nip. Then, the frictional heat is also generated on the above-described development nip.

The image forming apparatus according to the present exemplary embodiment includes a wind path configuration as described below to maintain a fixing performance of the fixing device 20 while indirectly cooling the portions where the frictional heat is generated.

(2) Wind Path Configuration

Figure 3:
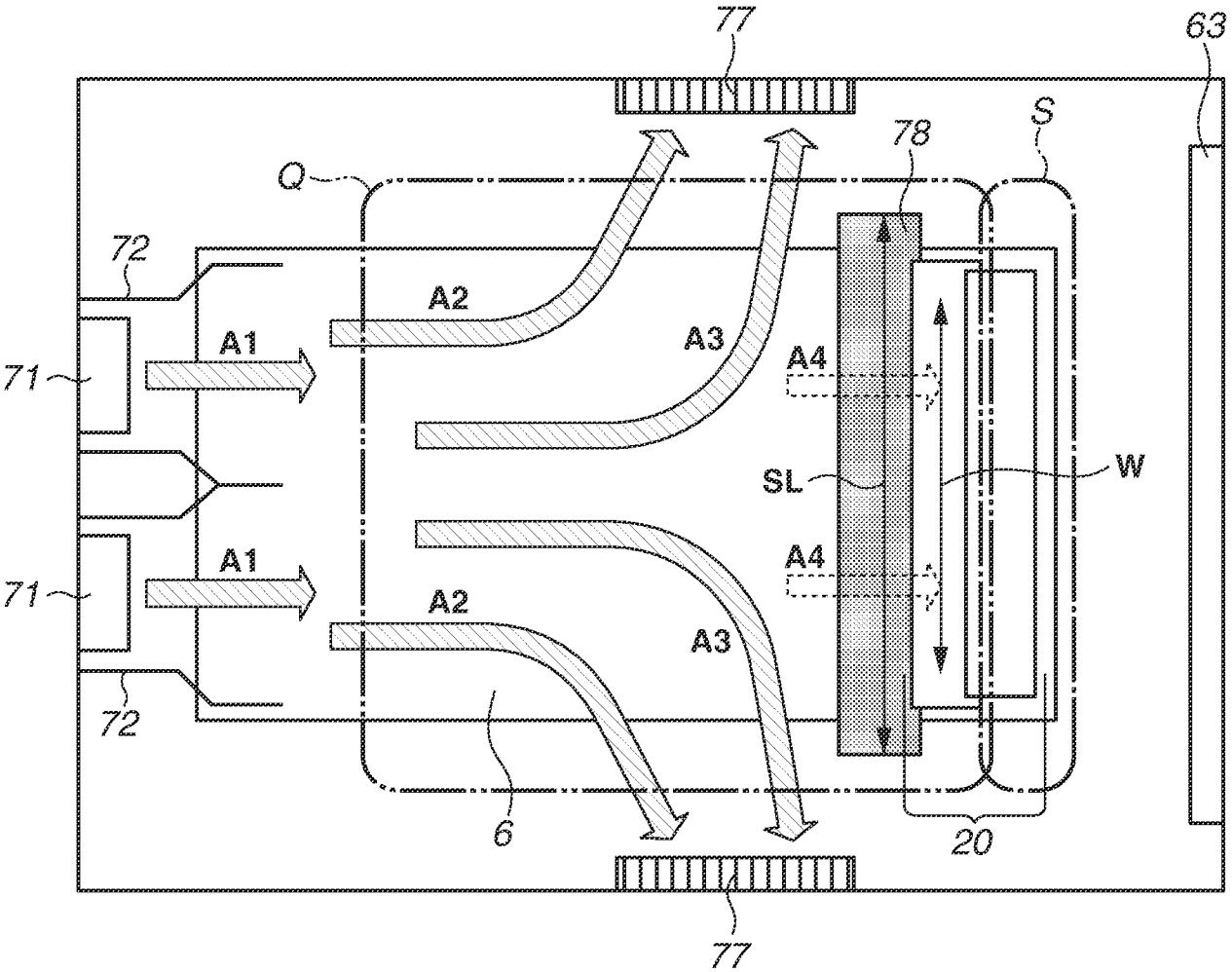
FIG. 3 illustrates the configuration of the image forming apparatus according to the first exemplary embodiment.

The wind path configuration and a block member of the image forming apparatus according to the present exemplary embodiment will be described with reference to FIGS. 1 and 3. FIG. 3 is a conceptual diagram illustrating the image forming apparatus according to the present exemplary embodiment as viewed through a top surface thereof, and illustrating the configuration of the wind path.

The image forming apparatus according to the present exemplary embodiment includes three slidingly rubbed portions. A first portion is where the drum cleaning member 41 rubs against the photosensitive drum 1, a second portion is where the development blade 22 rubs against the development roller 21, and a third portion is where the belt cleaning member 15 rubs against the intermediate transfer belt 6. An idea for cooling the slidingly rubbed portions is to indirectly cool the first and second slidingly rubbed portions by cooling the intermediate transfer belt 6 with an intake air current. For the third slidingly rubbed portion, the cooled intermediate transfer belt 6 reaches the slidingly rubbed portion by rotating, thereby directly cooling the third slidingly rubbed portion to reduce the generated heat.

The image forming apparatus according to the present exemplary embodiment includes two intake fans 71 on an upper left side as viewed in FIGS. 1 and 3, and each of the intake fans 71 is connected to the duct 72. Further, the duct 72 is connected to the inner wall 73 of the image forming apparatus. The inner wall 73 according to the present exemplary embodiment includes a facing portion 73A that faces the surface of the intermediate transfer belt 6. An air current A1 taken in by the intake fan 71 is supplied toward the inner wall 73 via the duct 72, cools the intermediate transfer belt 6 after the secondary transfer (air currents A2 and A3), and is discharged from an exhaust port 77 provided on a side surface of the image forming apparatus.

The inner wall 73 of the image forming apparatus includes the facing portion 73A, which faces the surface of the intermediate transfer belt 6 corresponding to a portion between the secondary transfer nip portion Tn (or the transfer roller 13, which is the transfer unit) and the belt cleaning member 15. The inner wall 73 of the image forming apparatus according to the present exemplary embodiment includes the facing portion 73A; however, the image forming apparatus may include a separate facing member that faces the surface of the intermediate transfer belt 6. For example, a frame member forming the image forming apparatus, an exterior of the image forming apparatus exposed on an inner surface, or the like may be used, or a plurality of members may be used as the facing portion. A dedicated wind path duct may also be used as the facing portion if especially necessary in light of the wind path.

Now, the image forming apparatus according to the present exemplary embodiment includes the block member that divides a space Q (indicated by a dashed-and-double-dotted line), which is a second space surrounded by the upper surface of the intermediate transfer belt 6 and the inner wall 73 of the image forming apparatus, in the rotational direction of the intermediate transfer belt 6. The block member 78 is a member intended to block an air current A4 heading toward the fixing device 20 from the air currents A2 and A3 that have cooled an exposed portion of the intermediate transfer belt 6 after the secondary transfer. Although the air current A4 is not generated due to the blocking by the block member 78 in the image forming apparatus according to the present exemplary embodiment, the air current A4 is described imaginarily for convenience of the description. As illustrated in FIG. 1, a top end of the block member 78 according to the present exemplary embodiment is fixed to or held by the facing portion 73A facing the intermediate transfer belt 6. The block member 78 may also be fixed to or held by the frame member 26 of the fixing device 20, the support member 75 of the fixing device 20, or the like in consideration of blocking the air current A4 without any gap. A part of the block member 78 overlaps the fixing device 20 when viewed vertically in a state where the image forming apparatus is set up. An end portion of the block member 78 that is one end side thereof and fixed to the facing portion 73A overlaps the fixing device 20 when viewed vertically. Desirably, the block member 78 is disposed to a side closer to the fixing device 20 to secure a large area as the portion of the intermediate transfer belt 6 that is cooled by the air currents A2 and A3.

As a location at which the block member 78 is disposed, desirably, the block member 78 is disposed to a position between the position in contact with the transfer unit (secondary transfer nip portion Tn) and the position in contact with the belt cleaning member 15 (cleaning nip Cn) on the circumference of the intermediate transfer belt 6 as a position that does not affect the image formation operation. If the block member 78 is disposed to the left of the center in FIG. 1 within a range where the block member 78 can be disposed on the intermediate transfer belt 6, the layout leads to a reduction in an area over which the intermediate transfer belt 6 to be cooled and the air currents A2 and A3 are in contact with each other. Thus, desirably, as illustrated in FIG. 1, the block member 78 is disposed to a position close to the fixing device 20, which is the fixing unit, in the horizontal direction in the space Q, which is the second space. In the present exemplary embodiment, the block member 78 is disposed to a position that is approximately 70 mm after passing through the secondary transfer nip portion Tn of the intermediate transfer belt 6 (on the left side of the secondary transfer nip portion Tn in FIG. 1) and that is approximately 350 mm before the cleaning nip Cn (on the right side of the cleaning nip Cn in FIG. 1). In other words, as illustrated in FIG. 1, the block member 78 divides the second space into two regions by being disposed in the second space.

The space Q is referred to as the second space, and the second space refers to a space formed between the surface of the image bearing member and the facing portion facing the surface. The space Q is the space surrounded by the top surface of the intermediate transfer belt 6 and the inner wall 73 of the image forming apparatus, and, in this case, the intermediate transfer belt 6 corresponds to the image bearing member and a part of the inner wall 73 corresponds to the facing portion 73A.

The block member 78 according to the present exemplary embodiment is disposed in such a manner that a bottom end of the block member 78 is in contact with the surface of the intermediate transfer belt 6. This is due to the following reason. The air current flowing onto the surface of the intermediate transfer belt 6 to be cooled freely flows depending on a direction of a motion vector of the air current and an atmospheric pressure in the image forming apparatus. Thus, if the block member 78 and the intermediate transfer belt 6 are in a non-contact state with each other, this results in a failure to completely block the flow heading toward the fixing device 20, which is the fixing unit, after passing through a non-contact region. In the image forming apparatus according to the present exemplary embodiment, a part of the space Q in which the target is cooled is spatially closed and thus the air current A4 heading toward the conveyance path space S is blocked by using the block member 78 with the one end side thereof fixed to the facing portion 73A and the other end side thereof in contact with the intermediate transfer belt 6. This configuration allows an optimum design to be achieved without consideration for the air current A4 flowing into the conveyance path space S where the recording material P is conveyed from the transfer unit to the fixing unit.

The block member 78 according to the present exemplary embodiment has a sheet form, and is configured in such a manner that a sheet surface of the sheet form is in contact with the surface of the intermediate transfer belt 6.

Figure 4A:
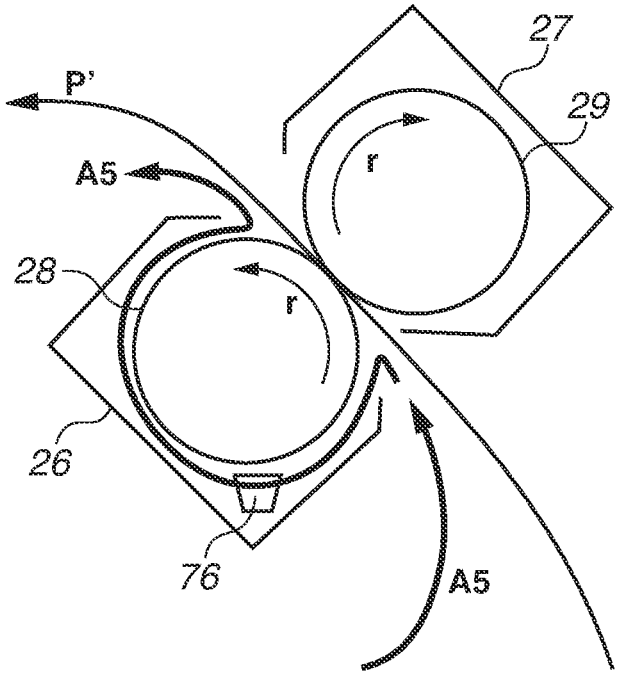
FIGS. 4A and 4B illustrate a relationship between a fixing device and an air current according to the first exemplary embodiment.

Fixability can be deteriorated if the block member 78 is not provided and the air current A4 flows into the fixing device 20, which is the fixing unit, for the following reason that will be described with reference to FIGS. 4A and 4B. FIG. 4A is an enlarged view illustrating a cross section of the fixing device 20, and FIG. 4B is a view schematically illustrating a layout in the longitudinal direction when the heating roller 28 is viewed from an upper right side in FIG. 1.

Figure 4B:
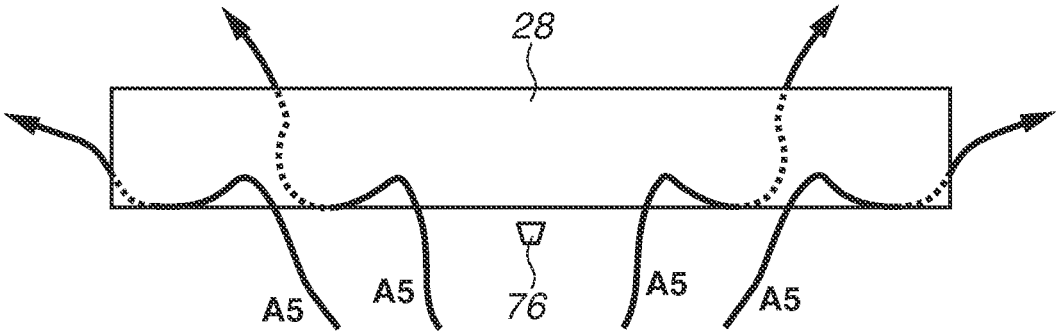

In FIGS. 4A and 4B, an arrow P, an arrow A5 and an arrow r represent conveyance of the recording material P, specific part of the air current A4 that flows into the fixing device 20, and rotational directions of the heating roller 28 and the pressing roller 29, respectively. As illustrated in FIG. 4A, when the recording material P is conveyed to the fixing device 20, the air current A5 heads toward a range where the atmospheric pressure is low, and the air current A5 flows toward a downstream side of the fixing device 20 in the conveyance direction of the recording material P via an outer periphery of the heating roller 28. The air current A5 does not necessarily flow evenly toward a longitudinal side of the heating roller 28. For example, when the image forming apparatus is configured so as to reduce the atmospheric pressure near the longitudinal end portions of the heating roller 28, as illustrated in FIG. 4B, a speed of the air current flowing in directions toward the end portions increases and temperature at the end areas of the heating roller 28 reduces. In the present exemplary embodiment, the temperature detection element 76, which detects the temperature on the surface of the heating roller 28, is provided at the longitudinal center of the heating roller 28, and therefore it is not possible to detect the reductions in the temperatures on the surfaces at the longitudinal end areas. This raises a possibility of undesirably reducing the fixability near the end portions of the heating roller 28.

The reduction in the temperature at the longitudinal end areas can be detected by providing a plurality of temperature detection elements 76 at the center, the end portions, and the like in the longitudinal direction of the heating roller 28. However, a state of unevenness of the temperature in the longitudinal direction of the heating roller 28 complicatedly changes depending on a combination of a paper width and a conveyance speed of the recording material P fed into the image forming apparatus, an operational capability of the intake fan 71, a temperature rise state in the image forming apparatus, and the like. For this reason, controlling the temperature in consideration of them is extremely cumbersome. Thus, the method that blocks the air current A4 with use of the block member 78 according to the present exemplary embodiment works as an effective method.

The bottom end of the block member 78 forms a slight contact nip by lightly being in contact with the intermediate transfer belt 6, and is dragged while sliding thereon with the rotation of the intermediate transfer belt 6. Desirably, the block member 78 is in contact with the intermediate transfer belt 6 at a low pressure to avoid exertion of a mechanical or electrostatic effect on the transfer residual toner on the intermediate transfer belt 6. For example, desirably, the block member 78 is disposed in such a manner that a pull-out pressure at the contact nip between the block member 78 and the intermediate transfer belt 6 is smaller than or equal to 1 N/m. Here, the pull-out pressure is measured by the following method. A stainless steel (i.e., SUS) plate 30 μm in thickness is inserted in the contact portion between the intermediate transfer belt 6 and the block member 78. Next, the SUS plate is pulled at a speed of 0.5 cm/sec in the rotational direction of the intermediate transfer belt 6, and a pull-out force at this time is measured and a value equivalent to a linear pressure is acquired by converting the measured pull-out force into a force per 1 m width of the SUS plate. Since the pull-out force is measured in a state of pulling out the SUS plate in the rotational direction of the intermediate transfer belt 6, the measurement is conducted with use of a method of removing a part of the components of the image forming apparatus at the time of the measurement, a method of using a tool/instrument for achieving the actual structural relationship between the intermediate transfer belt 6 and the block member 78 in the image forming apparatus, or the like.

A flexible sheet material such as artificial leather, an unwoven fabric, and a thin resin film is desirable as a material of the block member 78. The image forming apparatus according to the present exemplary embodiment uses a material prepared by processing an unwoven fabric made of polyester and polyurethane (Ecsaine 3000) (0.49 mm in thickness)) as the block member 78. A length of the block member 78 is set to 30 mm, while L, which is a height of a straight line from the surface of the intermediate transfer belt 6 to the inner wall 73 of the image forming apparatus, is set to L=20 mm. Thus, the sheet is in a deflected state with the one end side of the block member 78 fixed to the inner wall 73 and the sheet surface on the other end side thereof in contact with the surface of the intermediate transfer belt 6.

The block member 78 according to the present exemplary embodiment is disposed to the apparatus main body side, which is the frame of the image forming apparatus, and is configured to be in contact with the surface of the intermediate transfer belt 6 by installation of the transfer unit 80 into the apparatus main body of the image forming apparatus. Then, the block member 78 is gradually deflected with the rotation of the intermediate transfer belt 6 in the image forming apparatus, and forms the contact nip to shut off and block the flow of the air current A4.

The block member 78 may also be prepared as a sheet member, a block member, or a brush structure made of a foam material, an elastic material, or the like as long as it can provide an ability to lightly being in contact with the intermediate transfer belt 6 and an ability to block the space.

Desirably, a longitudinal length SL of the block member 78 (i.e., a length in a direction perpendicular to the conveyance direction of the recording material P) is longer than at least a maximum sheet-passing width W of the recording material P fed through the image forming apparatus. In the first place, it is desirable to block between the space Q and the conveyance path space S illustrated in FIG. 1 with the block member 78 without any gap for the purpose of blocking the air current A4. However, in reality, an attempt to establish the sealed shut-off across the longitudinal end portions of the apparatus without any gap with use of the block member 78 makes the structure complicated and increases costs because of requirements regarding, for example, meshed engagement between an input gear and a driven roller in the image forming apparatus and a support configuration of each of the rollers and the like, and therefore it is not practical. If the air current can be blocked in a range corresponding to the sheet-passing with of the recording material P, it is possible to prevent the air current A4 from flowing at least into the range of the fixing device 20 that corresponds to the sheet-passing width of the recording material P. Thus, the intended effect can be achieved as long as the longitudinal length SL of the block member 78 is longer than the maximum sheet-passing width W of the recording material P in the image forming apparatus. In the image forming apparatus according to the present exemplary embodiment, the longitudinal length SL of the block member 78 is set to 350 mm while the maximum sheet-passing width W of the recording material P is 320 mm.

The above-described length of the block member 78 is specified on an assumption that a length of the support portion of the block member 78 supported by the inner wall 73 of the image forming apparatus and a length of the contact portion of the block member 78 in contact with the intermediate transfer belt 6 are equal to each other. Needless to say, the support portion and the contact portion can be different from each other in length, but it is desirable that both of the portions are longer than the maximum sheet-passing width W of the recording material P. The block member 78 is in contact with the inner wall 73 of the image forming apparatus and the intermediate transfer belt 6 without any gap within the range corresponding to the above-described length, and blocks the air current A4 to prevent it from flowing into the conveyance path space S and drifting into the fixing device 20, which is the fixing unit.

(3) Experiment Example

Table 1 indicates the fixability when a fixing temperature of the fixing device 20 was changed on the image forming apparatus according to the present exemplary embodiment. The fixing temperature refers to the temperature on the surface of the heating roller 28 that is controlled by the control unit 50 based on the result of the detection by the temperature detection element 76. The fixability was determined based on whether an offset had occurred and whether an image deficit had occurred when a patch of 5 mm×5 mm was printed of a red image made by mixing yellow and magenta with use of the Red Label Presentation (80 g/m') paper manufactured by Canon.

As a comparative example, a similar evaluation to the above-described evaluation was made with use of an image forming apparatus with the block member 78 removed from the image forming apparatus according to the present exemplary embodiment. Symbols in table 1 of "○", "Δ", "x", "xx", and "▼" indicate that there was no image problem, a cold offset due to insufficient heating had occurred, an image deficit had occurred, a large number of image deficits had occurred, and a hot offset due to excessive heating had occurred, respectively.

Here, the offset means that a condition on an interface between the toner and the recording material P such as paper affects the image. For example, the cold offset refers to a phenomenon in which a toner image supposed to be fixed onto the recording material P is partially removed due to a force of adhesion or a force of electrostatic attraction to the heating roller 28 in a case where the heating roller 28 fails to sufficiently melt the toner near the interface between the toner and the recording material P.

TABLE 1

| | First Exemplary Embodiment | | Comparative Example | |
|---|---|---|---|---|
| Fixing Temperature (Degrees Celsius) | Center of Image | Edge Portion of Image | Center of Image | Edge Portion of Image |
| 165 | x | x | x | xx |
| 170 | Δ | Δ | Δ | x |
| 175 | ○ | ○ | ○ | Δ |
| 180 | ○ | ○ | ▼ | ○ |

As indicated in the table 1, the image forming apparatus according to the present exemplary embodiment resulted in no difference in the fixability between the center of the image and the edge portion of the image, and exhibited the insufficient heating at both the center and the edge portion of the image when the fixing temperature was 170 degrees Celsius or lower. On the other hand, the image forming apparatus according to the comparative example did not have a fixing temperature range that allowed the fixability to be maintained at both the center of the image and the edge portion of the image, and exhibited the insufficient heating at the edge portion of the image when the fixing temperature was 175 degrees Celsius or lower while exhibiting the excessive heating at the center of the image when the fixing temperature was 180 degrees Celsius or higher.

In the above-described manner, at the time of the cooling of the three slidingly rubbed portions, i.e., the photosensitive drum 1 and the drum cleaning member 41, the development roller 21 and the development blade 22, and the intermediate transfer belt 6 and the belt cleaning member 15, the rubbed portions are cooled with the wind blowing toward the intermediate transfer belt 6, which is the image bearing member. At this time, the space Q into which the blowing wind is supplied is partially divided by the block member 78, and the conveyance path space S is shut off and blocked from the air current in the space Q, similar to the image forming apparatus according to the present exemplary embodiment. As a result, the air current A4 derived from the above-described blowing wind can be prevented from flowing into the fixing device 20, thereby occurrence of a fixing failure can be prevented.

The difference between the present exemplary embodiment and the comparative example has been clarified herein, but the configuration according to the comparative example can still be used as the image forming apparatus. However, the configuration according to the present exemplary embodiment is desirable to better fix the toner image onto the recording material P.

Figure 5:
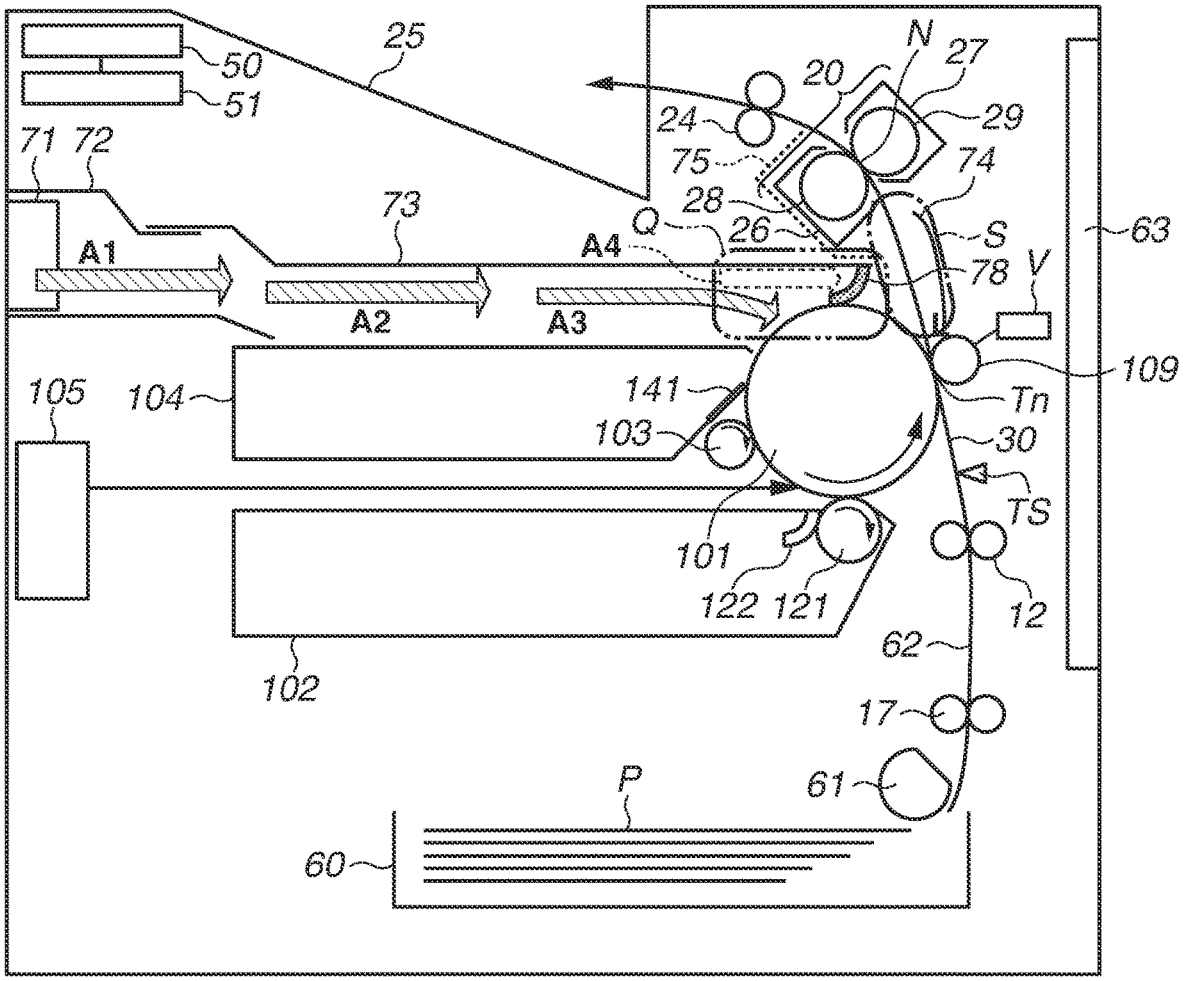
FIG. 5 illustrates a configuration of an image forming apparatus according to a second exemplary embodiment.

An image forming apparatus according to a second exemplary embodiment illustrated in FIG. 5 is a monochromatic laser printer. The image forming apparatus does not include the intermediate transfer belt 6 and the members accompanying it unlike the image forming apparatus according to the first exemplary embodiment. A conveyance route of the recording material P and a wind path configuration resemble those of the image forming apparatus according to the first exemplary embodiment.

The image forming apparatus according to the present exemplary embodiment includes a photosensitive drum 101, which is the image bearing member, a development device 102, which is the development unit, a charging roller 103, and a cleaning device 104, which is the cleaning unit. In the second exemplary embodiment, the image bearing member cooled with the current of the air acquired by suctioning external air is the photosensitive drum 101, which is different from the intermediate transfer belt 6 in the first exemplary embodiment. Further, the cleaning unit according to the second exemplary embodiment is the cleaning device 104 that removes toner remaining on a surface of the photosensitive drum 101, which is different from the cleaning device that removes the toner remaining on the intermediate transfer belt 6 in the first exemplary embodiment.

The development device 102, which is the development unit according to the present exemplary embodiment, includes a development roller 121 in contact with the photosensitive drum 101, and a development blade 122 in contact with the development roller 121. The cleaning device 104, which is the cleaning unit according to the present exemplary embodiment, includes a drum cleaning member 141, which removes the toner remaining on the surface of the photosensitive drum 101 (cleans the photosensitive drum 101) by coming in contact with the photosensitive drum 101.

An operation for forming the unfixed toner image onto the photosensitive drum 101 is similar to that of the image forming apparatus according to the first exemplary embodiment.

In the present exemplary embodiment, after forming the toner image onto the photosensitive drum 101, the image forming apparatus conveys the recording material P to the transfer nip portion Tn formed between the photosensitive drum 101 and a transfer roller 109, which is the transfer unit in contact with the photosensitive drum 101, and directly transfers the toner image from the photosensitive drum 101 onto the recording material P.

The air current A1 suctioned by the intake fan 71 is guided, via the duct 72, into a space between the inner wall 73 and a top surface of the cleaning device 104 (air current A2), and flows as far as the surface of the photosensitive drum 101 through this space (air current A3) to cool the surface of the photosensitive drum 101.

The surface of the photosensitive drum 101 at a position in contact with the air current is disposed so as to face the facing portion, which is a part of the inner wall 73 of the image forming apparatus (the space Q).

The photosensitive drum 101 serves as the image bearing member to be cooled in the present exemplary embodiment. Then, the air current A4 is blocked from flowing into the conveyance path space S by bringing the block member 78 into contact with the surface of the photosensitive drum 101 corresponding to a portion between the transfer roller 109, which is the transfer unit, and the cleaning device 104, which is the cleaning unit, similarly to the image forming apparatus according to the first exemplary embodiment. Similarly, the air current A4 heading from the space Q toward the fixing device 20 can be shut off and blocked by bringing the block member 78 into contact with the surface of the photosensitive drum 101 from the transfer nip portion Tn to the cleaning nip.

Figure 6:
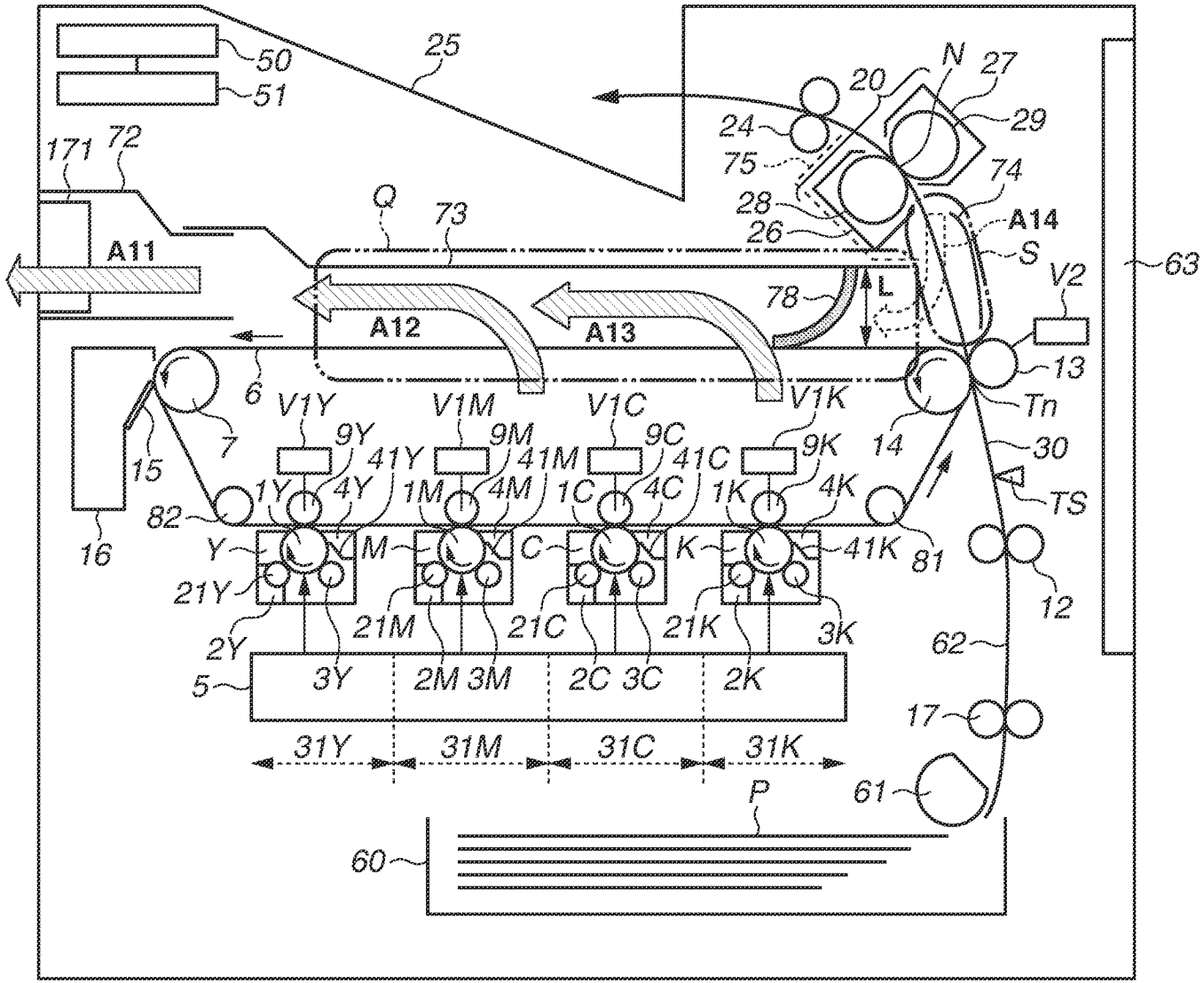
FIG. 6 illustrates a configuration of an image forming apparatus according to a third exemplary embodiment.
Figure 7:
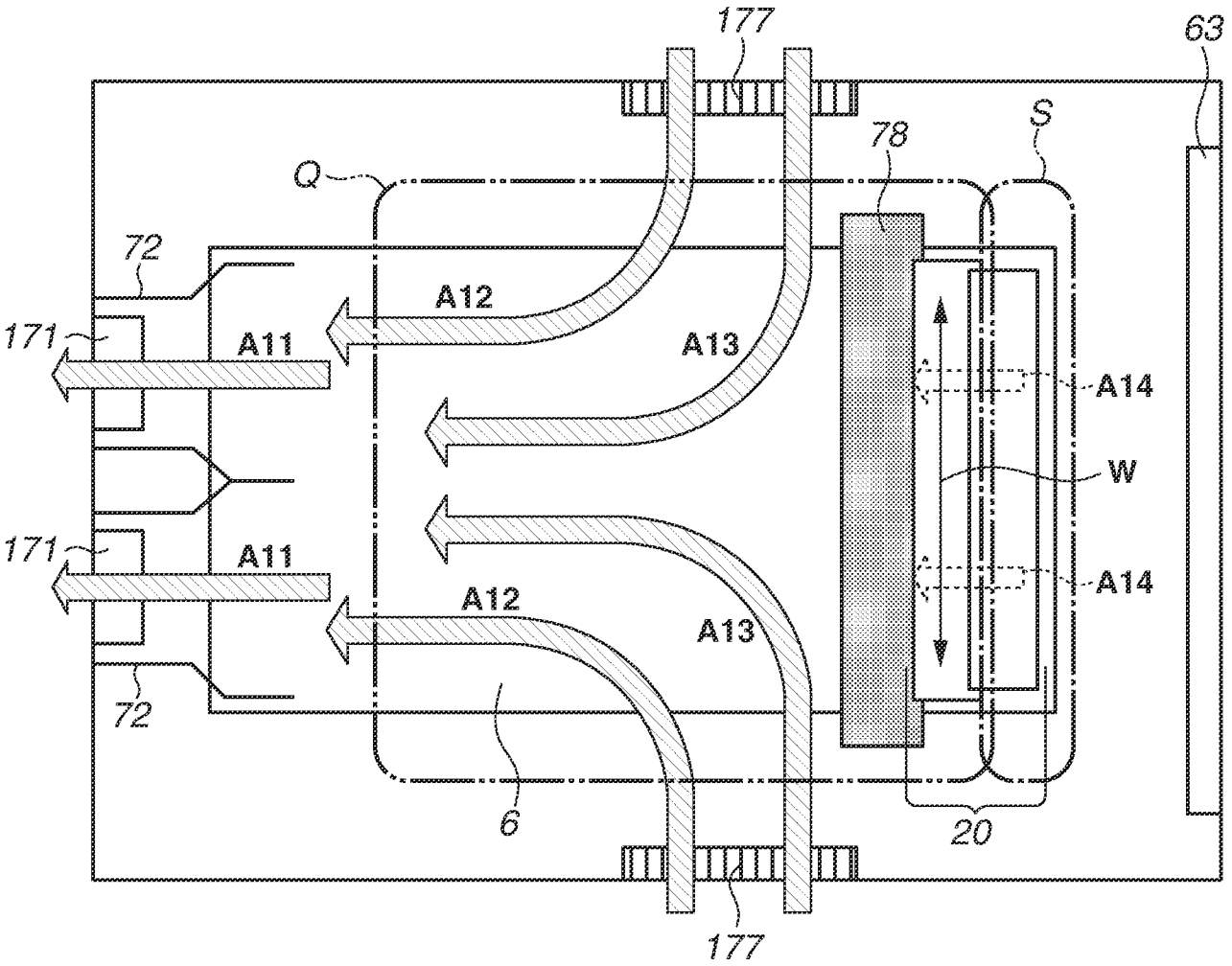
FIG. 7 illustrates the configuration of the image forming apparatus according to the third exemplary embodiment.

As illustrated in FIGS. 6 and 7, an image forming apparatus according to a third exemplary embodiment is configured in a similar manner to the first exemplary embodiment; however, it is different from the first exemplary embodiment only in terms of the wind path configuration.

More specifically, a fan 171 provided to the image forming apparatus according to the present exemplary embodiment is an exhaust fan, unlike that in the image forming apparatus according to the first exemplary embodiment. Thus, an opening 177 provided on a side surface of the image forming apparatus serves as an intake port, and air currents A12 and A13 suctioned through the intake port 177 flow into the space Q. The air currents A12 and A13 flowing in the space Q cools the exposed portion of the intermediate transfer belt 6 after the secondary transfer, and is guided by the duct 72 and discharged outward from the image forming apparatus by the exhaust fan 171 (air current A11).

The image forming apparatus according to the present exemplary embodiment uses the exhaust fan 171 unlike the image forming apparatus according to the first exemplary embodiment for the following reasons. The first reason relates to air intake. The intake portion is placed at the position of the intake fan 71 in the first exemplary embodiment, while the intake portion is placed at the position of the intake port 177 in the present exemplary embodiment. Then, in the first exemplary embodiment, the intake fan 71 is provided at the intake portion that suctions the external air, and the air flows at a higher speed at the intake portion than in the third exemplary embodiment. In other words, the flow speed is slow due to the absence of the fan at the intake portion in the third exemplary embodiment. Thus, dust is more easily suctioned in the first exemplary embodiment than in the third exemplary embodiment. The second reason relates to directionality of the air current. In the image forming apparatus according to the first exemplary embodiment, the suctioned air current A1 is guided by the duct 72 to the exposed portion of the intermediate transfer belt 6. Thus, the suctioned air current A1 becomes further directional by passing through the duct 72 and thus it may contact the surface of the intermediate transfer belt 6 at an uneven wind speed. In this case, cooling unevenness may occur on the surface of the intermediate transfer belt 6. On the other hand, in the image forming apparatus according to the third exemplary embodiment, the air current is supplied into the image forming apparatus with no specific duct provided after the air intake and at the low wind speed. Thus, the air currents A12 and A13 are not directional and can evenly cool the intermediate transfer belt 6.

The block member 78 is also effective in the image forming apparatus configured in this manner More specifically, the exhaust route is provided toward an upper left side in FIG. 6, and this layout leads to a relative reduction in the atmospheric pressure in the space Q compared to in the conveyance path space S, thereby resulting in generation of an air current A14 heading from the fixing device 20 toward the space Q. Because this air current A14 contains warm air derived from the fixing device 20, allowing it to directly flow toward the surface of the intermediate transfer belt 6 will impede the intended cooling and is thus undesirable. Therefore, the air current A14 heading from the fixing device 20 toward the space Q can be shut off or blocked by including the block member 78, similar to the image forming apparatus according to the present exemplary embodiment.

Figure 8:
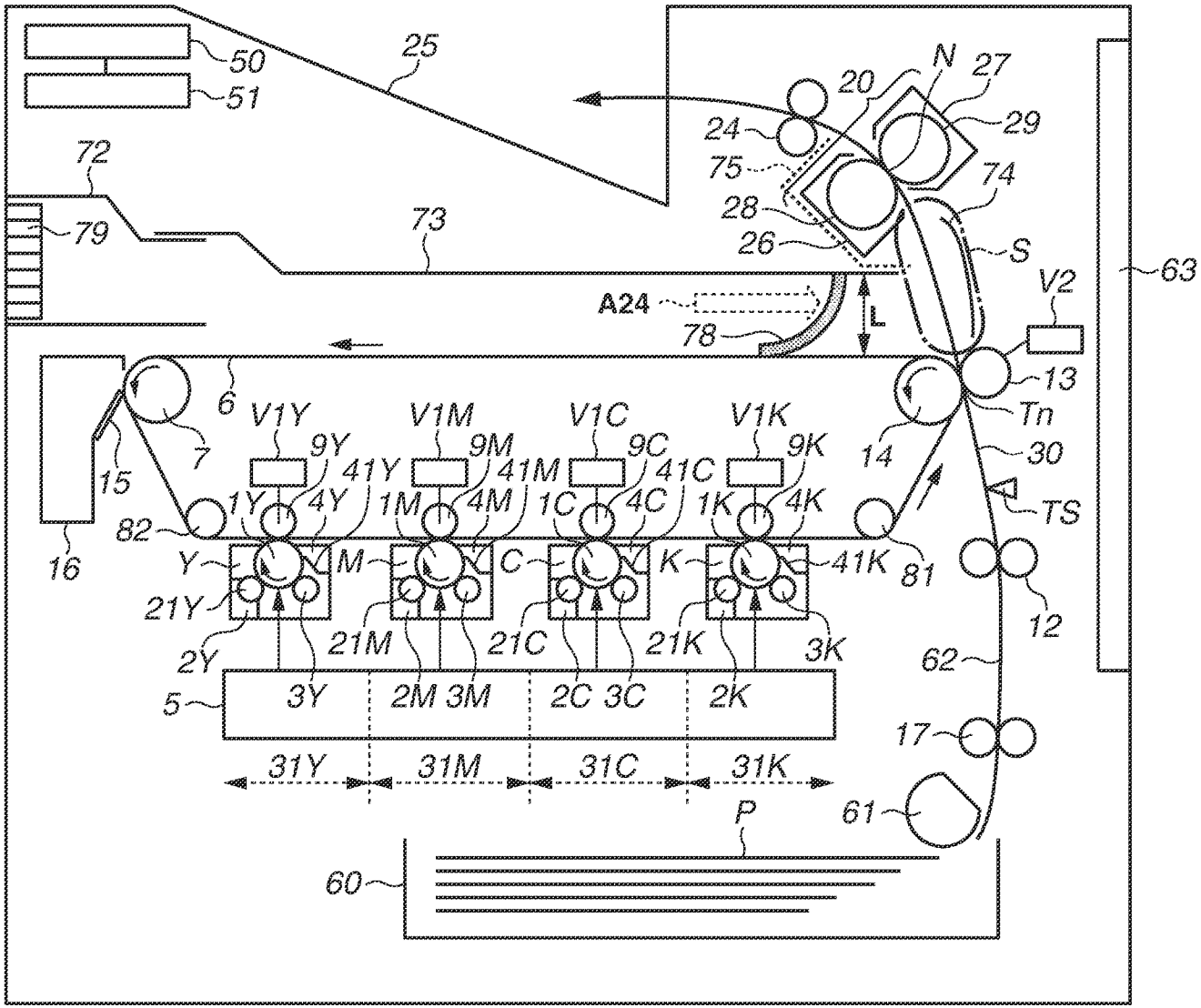
FIG. 8 illustrates a configuration of an image forming apparatus according to a fourth exemplary embodiment.
Figure 9:
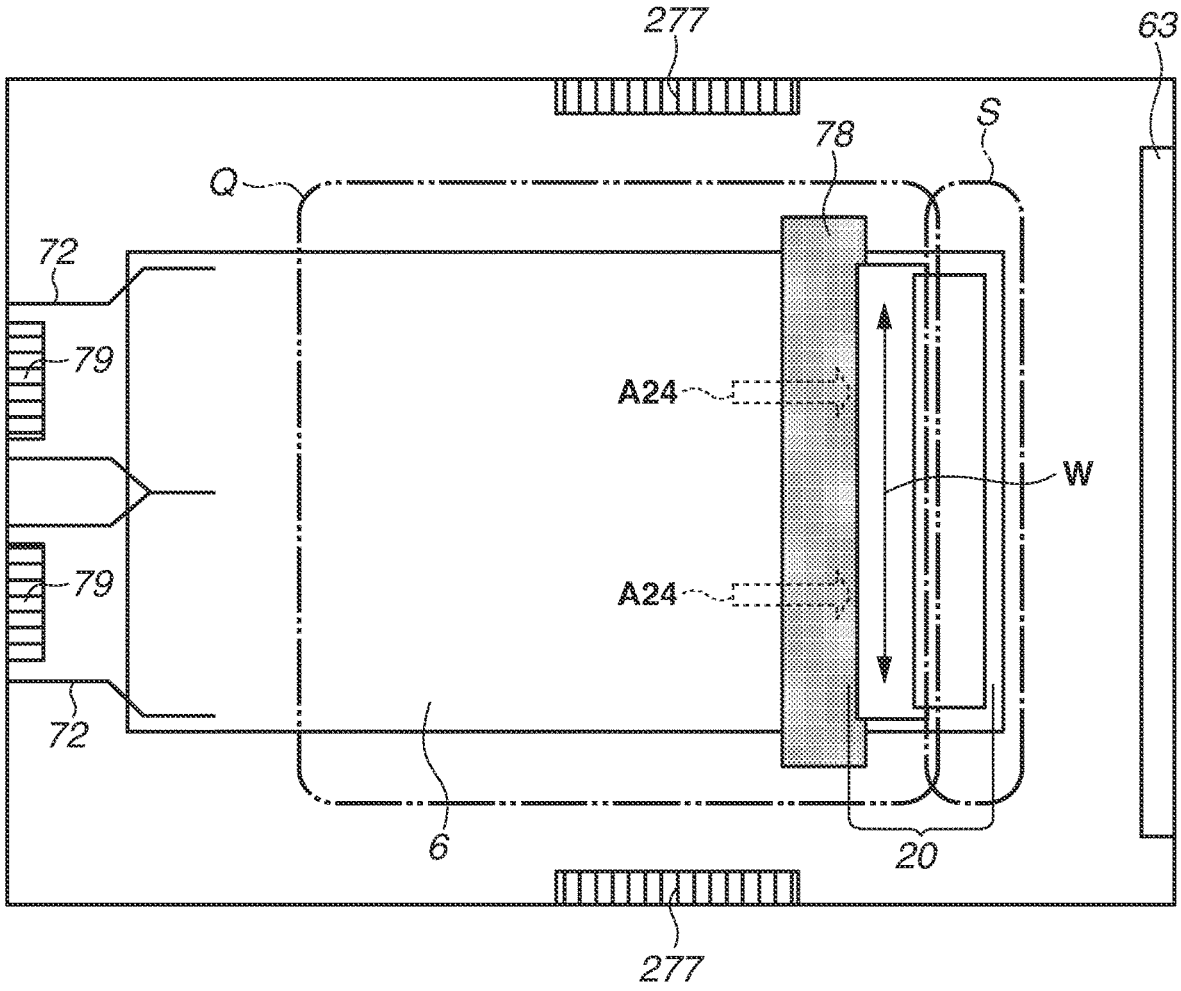
FIG. 9 illustrates the configuration of the image forming apparatus according to the fourth exemplary embodiment.
Figure 10A:
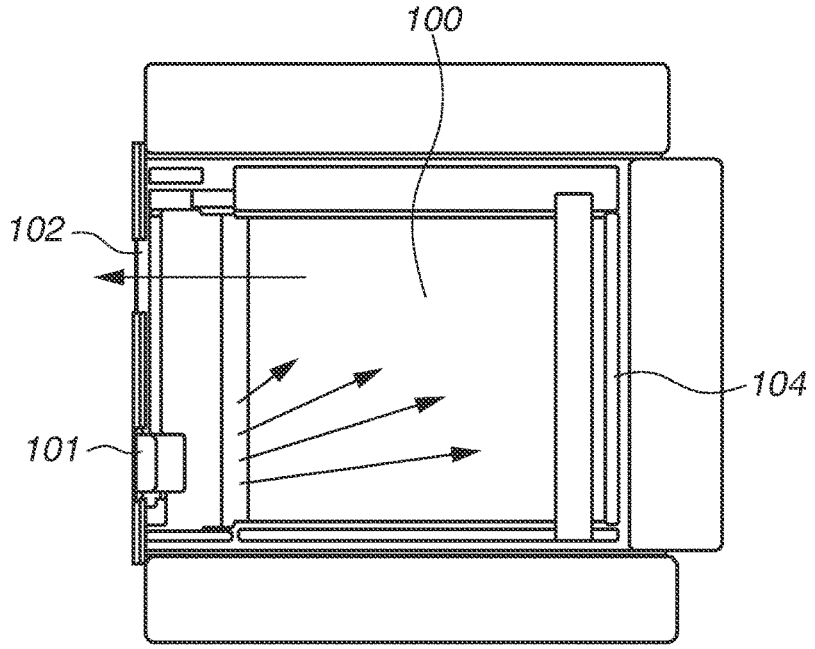
FIG.10A PRIOR ART
FIGS. 10A and 10B illustrate a configuration of an image forming apparatus according to a prior art.
Figure 10B:
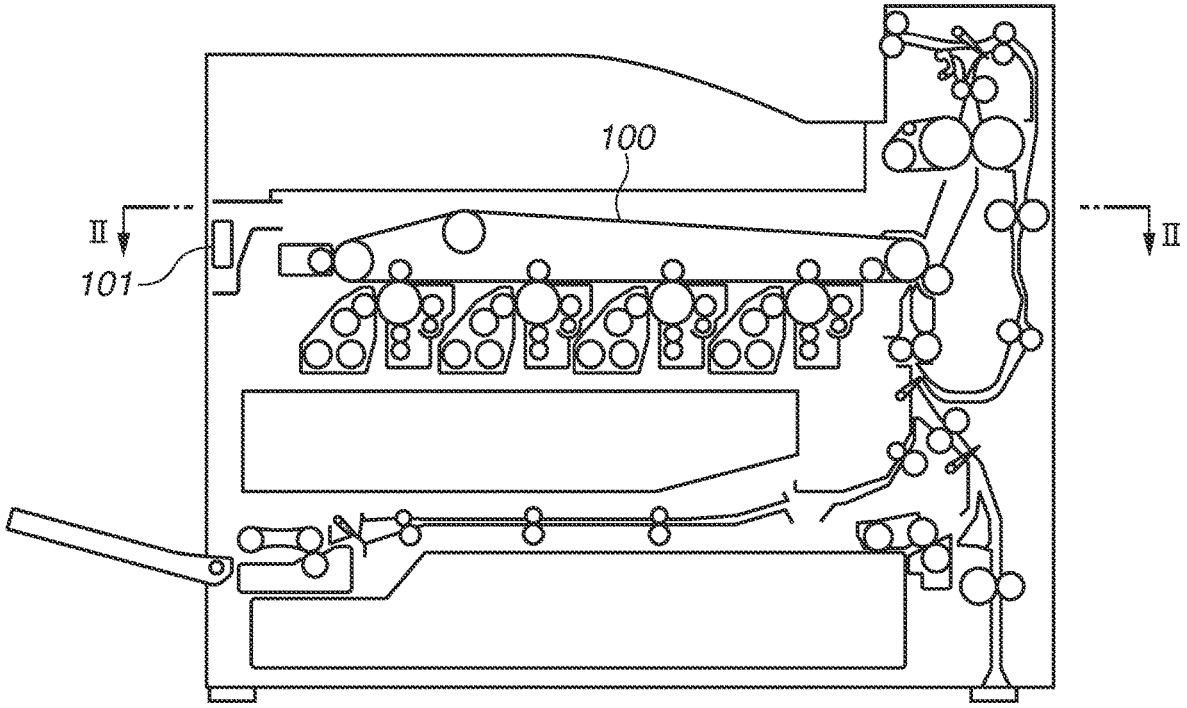
FIG.10B PRIOR ART

As illustrated in FIGS. 8 and 9, an image forming apparatus according to a fourth exemplary embodiment is configured in a similar manner to the first exemplary embodiment; however, it is different from the first exemplary embodiment only in terms of the conveyance speed of the recording material P and the wind path configuration.

More specifically, the conveyance speed of the recording material P is 90 mm/second in the image forming apparatus according to the present exemplary embodiment, and the conveyance speed is half as fast as that of the image forming apparatus according to the first exemplary embodiment. Accordingly, the photosensitive drum 1 and the intermediate transfer belt 6 are also rotated at half speeds, and therefore heat is generated by a smaller amount at the slidingly rubbed portions, which are the areas where the frictional heat is generated. The slidingly rubbed portions include the photosensitive drum 1 and the drum cleaning member 41, the development roller 21 and the development blade 22, and the intermediate transfer belt 6 and the belt cleaning member 15. Therefore, the image forming apparatus according to the present exemplary embodiment is not equipped with the blower fan in the wind path, and provides only air intake and exhaust by natural convection from an opening 79 and an opening 277. The surface of the intermediate transfer belt 6 serving as the image bearing member corresponding to a portion between the transfer unit and the belt cleaning unit, which is the cleaning unit, is cooled with use of the natural convection containing the external air.

On the other hand, the fixing device 20, which is the fixing unit, generates the heat to fix the toner, and therefore causes an ascending air current due to the heat generation and creates an air current A24 heading from the space Q relatively low in temperature toward the conveyance path space S. The fixing device 20 is also cooled by this air current A24, so that the provision of the block member 78 is also effective in the case where the blower fan is not provided, similar to the image forming apparatus according to the present exemplary embodiment.

The image forming apparatus has been disclosed as being configured to transfer the toner image borne on the photosensitive drum 1 onto the intermediate transfer belt 6 in the first exemplary embodiment, but may be configured to transfer the toner image borne on the photosensitive drum 1 onto the recording material P conveyed by a conveyance belt instead of the intermediate transfer belt 6.

In this case, the recording material P is conveyed to a contact portion between the photosensitive drum 1 and the conveyance belt. The conveyance belt is in contact with the photosensitive drum 1, and therefore indirectly cools the photosensitive drum 1 when a surface of the conveyance belt is cooled with the blowing wind. Cooling the surface of the photosensitive drum 1 can cool the cleaning nip portion where the photosensitive drum 1 is in contact with the drum cleaning member 41 and the development nip where the development blade 22 is in contact with the development roller 21.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-113186, filed Jun. 13, 2018, which is hereby incorporated by reference herein in its entirety.

What is claimed is:

1. An image forming apparatus comprising:

an image bearing member configured to bear a toner image;

a transfer unit configured to transfer the toner image from the image bearing member to a recording material;

a cleaning unit provided in contact with the image bearing member, and configured to remove toner remaining on the image bearing member after the transfer;

a fixing unit configured to fix the toner image onto the recording material by heating the toner image on the recording material; and a facing portion provided at a position facing a surface of the image bearing member that corresponds to a portion between the transfer unit and the cleaning unit, wherein a first space for conveying the recording material from the transfer unit to the fixing unit, and a second space between the surface of the image bearing member and the facing portion are formed in the image forming apparatus, and wherein the image forming apparatus further includes a block member that is provided in the second space in a bent state, and the block member comprises one end fixed to the facing portion and the other end in contact with the image bearing member at a portion farther from the first space than the one end so as to block airflow in the second space.

2. The image forming apparatus according to claim 1, further comprising:

a fan configured to feed the airflow to the second space.

3. The image forming apparatus according to claim 1, further comprising:

an opening configured to discharge the airflow in the second space outward from the image forming apparatus.

4. The image forming apparatus according to claim 1, wherein the block member blocks the airflow from the second space toward the first space.

5. The image forming apparatus according to claim 1, wherein a part of the block member overlaps the fixing unit when being viewed vertically.

6. The image forming apparatus according to claim 1, wherein the block member has a sheet form, and wherein a sheet surface of the sheet form is in contact with the image bearing member.

7. The image forming apparatus according to claim 1, wherein the block member is an unwoven fabric.

8. An image forming apparatus comprising:

an image bearing member configured to bear a toner image;

a development unit including a developer bearing member in contact with the image bearing member and a development blade in contact with the developer bearing member, and configured to develop the toner image on the image bearing member;

a transfer unit configured to transfer the toner image from the image bearing member to a recording material;

a fixing unit configured to fix the toner image onto the recording material by heating the toner image on the recording material; and a facing portion provided at a position facing a surface of the image bearing member, wherein a first space for conveying the recording material from the transfer unit to the fixing unit, and a second space between the surface of the image bearing member and the facing portion are formed in the image forming apparatus, and wherein the image forming apparatus further includes a block member that is provided in the second space in a bent state, and the block member comprises one end fixed to the facing portion and the other end in contact with the image bearing member at a portion farther from the first space than the one end so as to block airflow in the second space.

9. The image forming apparatus according to claim 8, further comprising:

a fan configured to feed the airflow to the second space.

10. The image forming apparatus according to claim 8, further comprising:

an opening configured to discharge the airflow in the second space outward from the image forming apparatus.

11. The image forming apparatus according to claim 8, wherein the block member blocks the airflow directed so as to flow from the second space toward the first space.

12. The image forming apparatus according to claim 8, wherein a part of the block member overlaps the fixing unit when being viewed vertically.

13. The image forming apparatus according to claim 8, wherein the block member has a sheet form, and wherein a sheet surface of the sheet form is in contact with the image bearing member.

14. The image forming apparatus according to claim 8, wherein the block member is an unwoven fabric.

15. An image forming apparatus comprising:

an image bearing member configured to bear a toner image;

a conveyance belt configured to convey a recording material;

a transfer unit configured to transfer the toner image from the image bearing member to the recording material;

a fixing unit configured to fix the toner image onto the recording material by heating the toner image on the recording material; and a facing portion provided at a position facing a surface of the conveyance belt, wherein a first space for conveying the recording material from the transfer unit to the fixing unit, and a second space between the surface of the conveyance belt and the facing portion are formed in the image forming apparatus, and wherein the image forming apparatus further includes a block member that is provided in the second space in a bent state, and the block member comprises one end fixed to the facing portion and the other end in contact with the conveyance belt at a portion farther from the first space than the one end so as to block airflow in the second space.

16. The image forming apparatus according to claim 15, further comprising:

a fan configured to feed the airflow to the second space.

17. The image forming apparatus according to claim 15, further comprising:

an opening configured to discharge the airflow in the second space outward from the image forming apparatus.

18. The image forming apparatus according to claim 15, wherein the block member blocks the airflow directed so as to flow from the second space toward the first space.

19. The image forming apparatus according to claim 15, wherein a part of the block member overlaps the fixing unit when being viewed vertically.

20. The image forming apparatus according to claim 15, wherein the block member has a sheet form, and wherein a sheet surface of the sheet form is in contact with the image bearing member.

21. The image forming apparatus according to claim 15, wherein the block member is an unwoven fabric.

* * * * *